US005818412A

United States Patent [19]

Maekawa

[11] Patent Number: 5,818,412

[45] Date of Patent: Oct. 6, 1998

[54] HORIZONTAL DRIVER CIRCUIT WITH FIXED PATTERN ELIMINATING FUNCTION

[75] Inventor: Toshikazu Maekawa, Kanagawa, Japan

[73] Assignee: Sony Corporation, Tokyo, Japan

[21] Appl. No.: 297,718

[22] Filed: Aug. 30, 1994

Related U.S. Application Data

[63] Continuation of Ser. No. 10,186, Jan. 28, 1993, abandoned.

[30] Foreign Application Priority Data

Jan. 31, 1992 [JP] Japan ..... 4-042084

[51] Int. Cl.[6] ..... G09G 3/36

[52] U.S. Cl. ..... 345/100; 345/98

[58] Field of Search ..... 345/99, 100, 98, 345/94, 90, 92, 87, 88, 89; 348/790, 791, 792, 793; 359/54, 55; 349/33, 34

[56] References Cited

U.S. PATENT DOCUMENTS

| | | | |
|---|---|---|---|
| 4,545,649 | 10/1985 | Gharadjedaghi | 350/356 |
| 4,724,433 | 2/1988 | Inoue | 345/87 |
| 4,746,915 | 5/1988 | Sekiya | 345/98 |
| 4,873,516 | 10/1989 | Castleberry | 340/784 |

FOREIGN PATENT DOCUMENTS 0 190 738 8/1986 European Pat. Off. .

OTHER PUBLICATIONS

Archer, "Semiconductor Replacement Guide". 1980 p. 30.

Shimizu, et al. "A 6.7 Inch Square High Resolution Full Color TFT–LCD" Japan Display '89. pp. 514–517.

*Primary Examiner*—Xiao Wu

*Attorney, Agent, or Firm*—Hill & Simpson

[57] ABSTRACT

A horizontal driver circuit comprising a shift register for generating horizontal sampling pulses sequentially; and a fixed pattern eliminating circuit, associated with the shift register, for providing a non-overlap time of the horizontal sampling pulses between an Nth stage and an Mth stage posterior thereto. The Mth stage horizontal sampling pulse has a rise whose phase is the same as that of a fall of the Nth stage horizontal sampling pulse. The fixed pattern eliminating circuit comprises means for controlling the rise of the horizontal sampling pulse of the Mth stage by the fall of the horizontal sampling pulse of the Nth stage. The horizontal driver circuit is applicable to a two-dimensional addressing device and a liquid crystal display device to eliminate a fault of vertical streaks on a displayed image.

21 Claims, 8 Drawing Sheets

HORIZONTAL DRIVER CIRCUIT WITH FIXED PATTERN ELIMINATING FUNCTION

This is a continuation of application Ser. No. 08/010,186, filed Jan. 28, 1993, now abandoned.

BACKGROUND OF THE INVENTION

1. Field of the Invention

The present invention relates to an active matrix type liquid crystal display device comprising active elements such as thin film transistors disposed at intersections of gate lines and data lines in a matrix array, and picture element electrodes corresponding to such active elements. And more particularly, the invention relates to a horizontal driver circuit for distributively supplying video signals to data lines in a line sequential mode.

2. Description of the Prior Art

For the purpose of making the present invention better understood with facility, there is shown in FIG. 8 a general equivalent circuit representing the background prior art in an active matrix type liquid crystal display device. As shown, the liquid crystal display device of such type comprises a plurality of gate lines X1, X2, . . . arranged in parallel with one another in the X-axis direction; and a plurality of data lines Y1, Y2, . . . arranged in parallel with one another in the Y-axis direction. Active elements such as thin film transistors (TFTs) T11, T12, T21, T22, . . . are disposed at the intersections of the gate lines and the data lines. And, liquid crystal cells L11, L12, L21, L22, . . . are also disposed correspondingly to the thin film transistors. Gate electrodes of the TFTs are connected respectively to the gate lines while source electrodes thereof are connected respectively to the data lines, and drain electrodes thereof are connected respectively to picture element electrodes of the corresponding liquid crystal cells. Each of the liquid crystal cells is composed of liquid crystal held between one picture element electrode and a common electrode COM opposed thereto.

The data lines Y1, Y2, . . . are connected via corresponding switching transistors S1, S2, . . . respectively to a common signal line SIG, to which a video signal is supplied from an external source. And, a horizontal driver circuit is connected to the gate electrode of each switching transistor. The horizontal driver circuit sequentially feeds horizontal switch driving pulses ϕ1, ϕ2, . . . to the gate electrodes of the switching transistors in synchronism with horizontal clock pulses HCLK input from an external source. Meanwhile, the gate lines X1, X2, . . . are connected to an unshown vertical driver circuit.

Now the operation of the circuit shown in FIG. 8 will be briefly described below. When an unshown vertical driver circuit is actuated, the gate lines are sequentially excited so that the TFTs are selected row by row. If the horizontal driver circuit is actuated at this time to operate the switching transistors line-sequentially, the video signals supplied to the signal line SIG are sequentially sampled at the data lines. The video signals thus sampled are sequentially written in the corresponding liquid crystal cells via the TFTs selected row by row. In this manner, the data of the sampled video signals are written dot-sequentially in the individual liquid crystal cells.

Next the problems to be solved by the present invention will be described briefly with reference to FIG. 9. The horizontal driver circuit shown in FIG. 8 comprises a shift register and so forth and sequentially produces horizontal switch driving pulses ϕ1, ϕ2, . . . as output signals. This driver circuit is so designed that the preceding pulse ϕ1 and the succeeding pulse ϕ2 generated therefrom do not overlap mutually with regard to logic levels. Practically, however, there occurs a partial overlap due to some jitter derived from waveform distortion or the like in the leading and trailing edges of the pulses. In other words, the mutually adjacent pulses interfere with each other. The quantity of such jitter is inherent in and dependent on the electric characteristics of the individual device in each stage of the shift register. Therefore, the overlap pattern between pulse trains is fixed, and a specific quantity of jitter tends to appear continuously in a specific stage of the shift register.

As described above, first the switching transistor S1 is turned on in response to the preceding pulse ϕ1, and then the video signal from the common signal line SIG is sampled at the corresponding data line Y1. Subsequently, the switching transistor S2 is turned on in response to the succeeding pulse ϕ2, and the video signal from the common signal line SIG is sampled at the corresponding data line Y2. However, if any jitter is existent at this time, the succeeding pulse ϕ2 rises or turns on before a fall of the preceding pulse ϕ1, so that a potential fluctuation is caused in the signal line SIG by the charge-discharge current during such period of time. Since the potential fluctuation is induced prior to the fall of the preceding pulse, it is sampled at the data line Y1 to consequently bring about an error in the sample data of the data line Y1 . As this error depends on the jitter quantity, it follows that the error appears continuously in a specific stage where the jitter quantity is particularly great. On the whole display screen, such error is seen like a vertical streak to eventually raise a problem that the image quality is extremely deteriorated. Generally, a video driver for outputting a video signal to the signal line SIG has a high output impedance, and since the impedance of the signal line is also high, harmful influence is considerably exerted by the jitter of the horizontal switch driving pulses to eventually render conspicuous the vertical streak or fixed overlap pattern on the displayed image. Furthermore, if the so-called simultaneous R-G-B driving is performed in an attempt to reduce the power consumption while lowering the clock pulse frequency for the horizontal driver circuit, the apparent number of columns of picture elements is decreased to consequently worsen the drawbacks relative to vertical streaks.

OBJECT AND SUMMARY OF THE INVENTION

The present invention has been accomplished in view of the above problems observed in the prior art. And, it is an object of the invention to provide an improved horizontal driver circuit which is employed in an active matrix type liquid crystal display device and is equipped with a fixed overlap pattern eliminating function so as to remove the aforementioned fault of vertical streaks on a displayed image.

According to one aspect of the present invention, there is provided a horizontal driver circuit comprising a shift register for generating horizontal sampling pulses sequentially; and a fixed pattern eliminating circuit, associated with the shift register, for providing a non-overlap time of the horizontal sampling pulses between an Nth stage and an Mth stage posterior thereto. The Mth stage horizontal sampling pulse has a rise whose phase is the same as that of a fall of the Nth stage horizontal sampling pulse. The fixed pattern eliminating circuit comprises means for controlling the rise of the horizontal sampling pulse of the Mth stage by the fall of the horizontal sampling pulse of the Nth stage.

According to another aspect of the present invention, there is provided an addressing device comprising a plurality of gate lines arranged substantially in parallel with each other in the X-axis direction; a plurality of data lines arranged substantially in parallel with each other in the Y-axis direction; a first scanning means for supplying gate signals sequentially to the gate lines; a second scanning means for supplying data signals sequentially to the data lines, the second scanning means comprising a shift register for sequentially generating horizontal sampling pulses, a fixed pattern eliminating circuit associated with the shift register, a delay circuit for delaying outputs from the fixed pattern eliminating circuit, and switch elements for providing data signals to the data lines in response to outputs from the delay circuit; and active elements disposed at intersecting points of the gate and data lines. The fixed pattern eliminating circuit serves to provide a non-overlap time of the horizontal sampling pulses between an Nth stage and an Mth stage posterior thereto, and the Mth stage horizontal sampling pulse has a rise whose phase is the same as that of a fall of the Nth stage horizontal sampling pulse.

According to a further aspect of the present invention, there is provided a liquid crystal display device comprising a plurality of display elements arranged in a matrix, each display element comprising a picture element electrode and a switching element associated with the picture element electrode, the switching element having first and second electrodes, a plurality of gate lines associated with the first electrode; a plurality of data lines associated with the second electrodes; and a scanning circuit having a control means for generating a non-overlap time of horizontal sampling pulses so that the rise of an Mth pulse is controlled by the fall of an Nth pulse, the rise of the Mth pulse being substantially the same in phase as the fall of the Nth pulse, to thereby sample video signals to be sequentially supplied to the data lines.

In the present invention, a fixed pattern eliminating circuit is connected to the output of the shift register for sequentially generating horizontal sampling pulses. Such fixed pattern eliminating circuit controls, by the use of an Nth stage preceding horizontal sampling pulse as a control signal, the output timing of the Mth stage succeeding horizontal sampling pulse whose rise is the same in phase as the fall of the Nth stage preceding horizontal sampling pulse. In other words, the output of the succeeding pulse is inhibited during the output of the preceding pulse so that the succeeding pulse rises exactly after the fall of the preceding pulse. Furthermore, the succeeding pulse output from the fixed pattern eliminating circuit is supplied, after delay of a predetermined time, to a corresponding video signal sampling switch. As a result, there never occurs an overlap between the preceding sample corresponding to the Nth stage in the shift register and the succeeding sample corresponding to the Mth stage therein, whereby a fault of vertical streak or a fixed overlap pattern can be eliminated. In the present invention, where a preceding pulse is used for controlling the output timing of a succeeding pulse, it becomes possible to remove the necessity of adding any circuit of a complicated configuration or a clock pulse source either.

The above and other features and advantages of the present invention will become apparent from the following description which will be given with reference to the illustrative accompanying drawings.

DETAILED DESCRIPTION OF THE PREFERRED EMBODIMENTS

Figure 1:
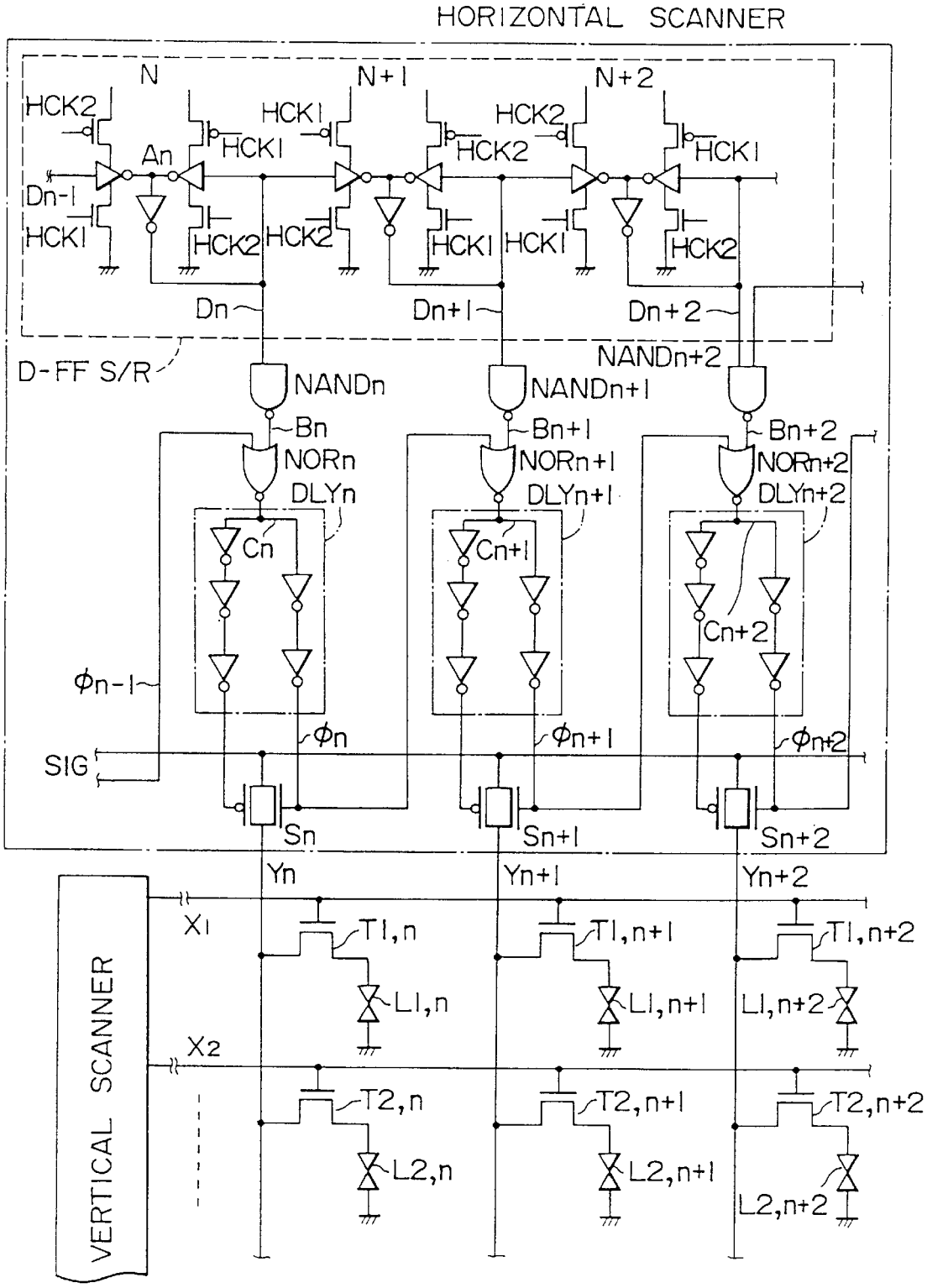
FIG. 1 is a circuit diagram of an exemplary active matrix type liquid crystal display device where the horizontal driver circuit of the present invention is applied.

Hereinafter a preferred embodiment of the present invention will be described in detail with reference to the accompanying drawings. FIG. 1 is a typical circuit block diagram in an exemplary case of applying the present invention to an active matrix type liquid crystal display device. It is to be understood that the present invention is generally applicable to a two-dimensional addressing device as well without being limited merely to such two-dimensional display device alone.

As shown, the display device comprises a plurality of gate lines X1, X2, . . . arranged in parallel with one another in the X-axis direction, a plurality of data lines Yn, Yn+1, Yn+2, . . . arranged in parallel with one another in the Y-axis direction, a first scanner or vertical scanner 10 for supplying gate signals line-sequentially to the gate lines, and a second scanner or horizontal scanner 12 for supplying video signals line-sequentially to the data lines.

Active elements, such as thin film transistors (TFTs) $T_{1,n}$, $T_{1,n+}$, $T_{1,n+2}$, $T_{2,n}$, $T_{2,n+1}$, $T_{2,n+2}$ . . . , are disposed respectively at the intersections of the gate lines and the data lines. And, liquid crystal cells $L_{1,n}$, $L_{1,n+1}$, $L_{1,n+2}$, $L_{2,n}$, $L_{2,n+1}$, $L_{2,n+2}$, . . . are connected respectively to the individual TFTs. Each of the liquid crystal cells is composed of a picture element electrode, a common electrode opposed thereto, and a liquid crystal layer held between the two electrodes. Drain electrodes of the TFTs are connected to the picture element electrodes, while gate electrodes thereof are connected to the corresponding gate lines, and source electrodes thereof are connected to the corresponding data lines. The TFTs are selected row by row in accordance with the gate signals supplied from the gate lines and, after dot-sequentially accessing the video signals supplied from the data lines, writes the video signals in the corresponding liquid crystal cells.

Such picture element electrodes, TFTs, gate lines, data lines, vertical scanner 10 and horizontal scanner 12 are so arrayed as to form a matrix on one substrate, although not shown, by the semiconductor process. Meanwhile, the common electrode is provided on another substrate. An active matrix type liquid crystal display device can be constituted by holding a liquid crystal layer between the two substrates opposed to each other via a predetermined space retained therebetween.

The circuit configuration of the horizontal scanner 12, which is a principal component in the present invention, will now be described below in detail with further reference to FIG. 1. The horizontal 12 scanner has a shift register S/R where a multiplicity of stages of n-type flip-flops (D-FF) are connected. For the purpose of simplifying the diagram, merely its Nth stage through (N+2)th stage are extracted and shown. A NAND element is connected to the output of each stage in the shift register. Here, a suffix is added to a reference symbol NAND for representing the correlation to each stage in the shift register. For example, a NAND element connected to the Nth stage output terminal is expressed as NANDn. In the following description, similar suffixes will be used also with regard to any other kinds of elements and signal pulses in conformity to the above rule when there is the necessity of representing the correlation to the stages in the shift register. Horizontal sampling pulses B are sequentially output from the NAND elements. These sampling pulses will be termed "primary pulses B" below since such pulses still contain some jitter prior to elimination of the fixed overlap pattern.

A NOR element is connected to the output terminal of each NAND element. A group of such NOR elements constitute a fixed pattern eliminating circuit. Furthermore, a delay element DLY is connected to the output terminal of each NOR element. And, a group of such delay elements constitute a delay circuit. From the output terminal of the delay circuit, there are delivered horizontal sampling pulses $\phi$ posterior to elimination of the jitter and a predetermined delay process. Hereinafter such pulses already processed as mentioned will be termed "secondary pulses $\phi$". Practically, the output signal of the delay element DLY includes secondary pulses $\phi$ and inverted pulses thereof. A transmission gate element S is connected to a pair of output terminals of the delay element. And, a group of the transmission gate elements constitute switch means. The input terminals of the transmission gate elements are connected to a common signal line SIG through which video signals are supplied, and the output terminals thereof are connected respectively to the corresponding data lines Y. The transmission gate elements are turned on merely during the supply of the secondary pulses $\phi$ thereto, so that the video signals are supplied and transferred sequentially to the corresponding data lines Y.

The primary pulses B are supplied as described to one input terminal of each NOR element constituting the fixed pattern eliminating circuit, while the secondary pulses $\phi$ are supplied to the other input terminal thereof. The NOR element controls, by using the preceding secondary pulse $\phi$ as a control signal, the output timing of the succeeding primary pulse B whose rise is the same in phase as the fall of the preceding secondary pulse. In this embodiment, the rise timing of the next-stage primary pulse B is controlled in accordance with the preceding-stage secondary pulse $\phi$. For example, the Nth stage element NORn executes gate control of the primary pulse Bn in accordance with the secondary pulse $\phi n-1$.

In this embodiment, each delay element DLY constituting the delay circuit consists of series-connected inverters. A desired delay time is attainable by setting the number of connected inverters to an adequate value. It is to be noted here that there occurs a predetermined delay in the NOR element as well. Consequently, the total delay time in the entire circuit is the sum of the delay in the NOR element and that in the delay element DLY.

Figure 2:
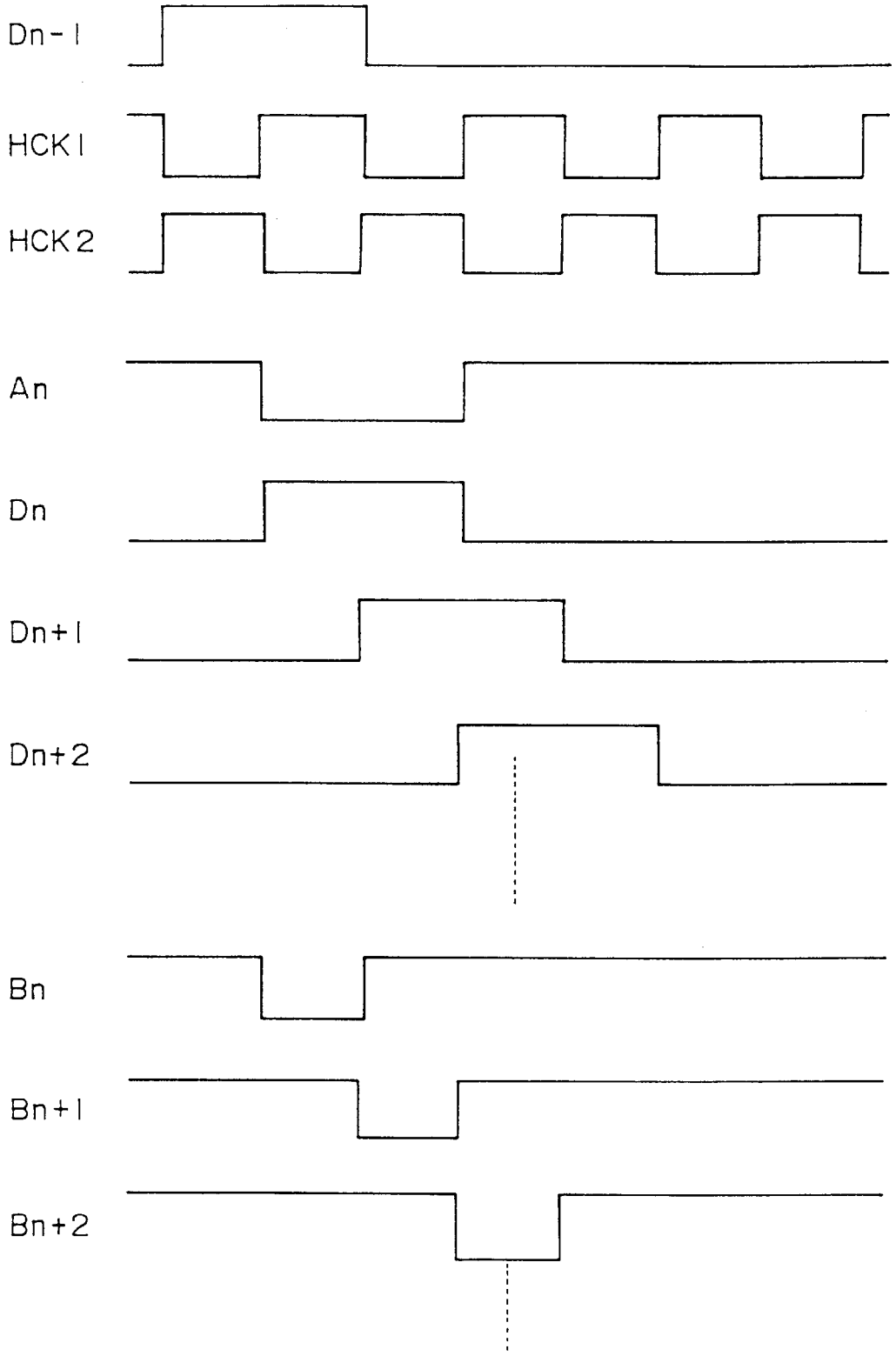
FIG. 2 is a timing chart of signals for explaining the operation of the horizontal driver circuit shown in FIG. 1.
Figure 3:
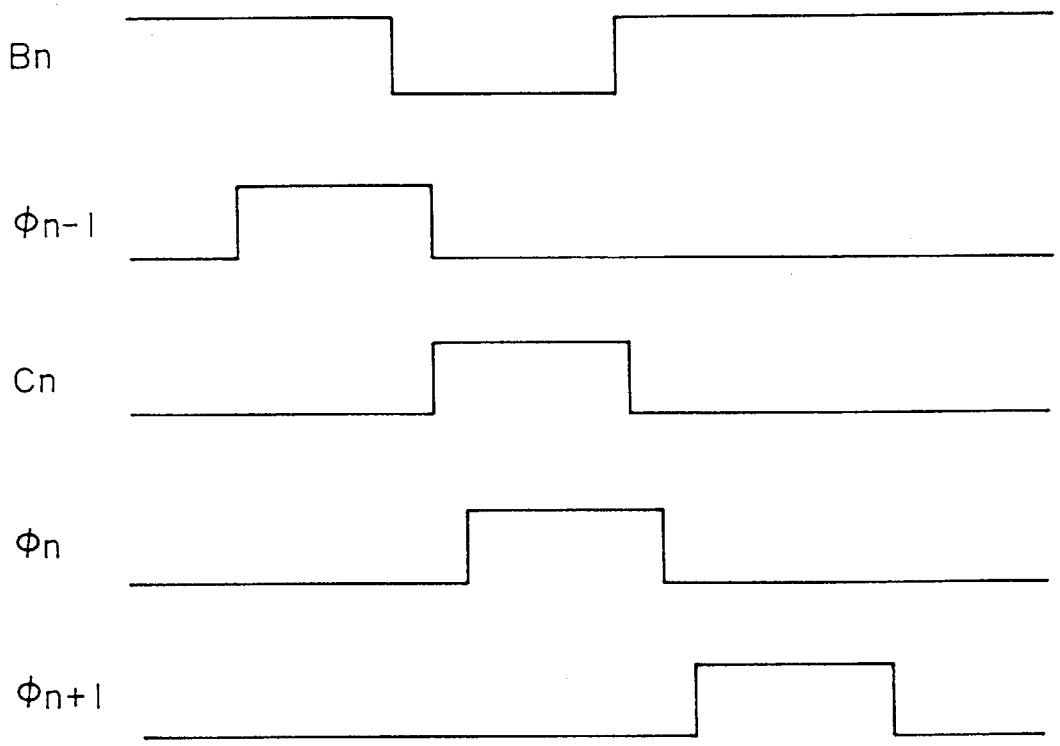
FIG. 3 is another timing chart of signals for explaining the operation of the horizontal driver circuit shown in FIG. 1.

Now the operation of the horizontal scanner 12 shown in FIG. 1 will be described below in detail with reference to FIGS. 2 and 3. Referring first to the timing chart of FIG. 2, a description will be given on how a primary pulse B is output from the shift register S/R. A data pulse Dn−1 is transferred from the preceding stage to the Nth stage D-FF of the shift register S/R. Meanwhile, a horizontal clock signal HCK1 and its inverted signal HCK2 are supplied to each stage in the shift register. In this embodiment, the width of the data pulse D is set to a duration equal to one period of the clock signal. The data pulse Dn−1 input from the preceding stage to the Nth stage in the shift register is delayed by a time length equal to half the period of the clock signal and is inverted by the paired inverters. In FIG. 2, An represents the waveform of the pulse thus processed. The pulse An is further inverted by another inverter so that an Nth stage data pulse Dn is obtained. As obvious from the timing chart, the data pulse Dn is shifted, in comparison with the preceding stage data pulse Dn−1 , by a time length equal to half the period of the clock signal. In this manner, data pulses Dn, Dn+1, Dn+2, . . . and so forth, each shifted by half the period of the clock signal, are sequentially output from the shift register S/R.

NAND elements are connected respectively to the output terminals of the individual stages in the shift register. For example, the element NANDn connected to the Nth stage produces a primary pulse Bn as an output by executing a NAND process of the Nth stage data pulse Dn and the next stage data pulse Dn+1. Similarly, the element NANDn+1 connected to the (N+1)th stage output terminal produces a next primary pulse Bn+1. Each of the primary pulses B thus output sequentially has a duration equal to half the period of the clock signal and is shifted by a time length equal to the pulse duration thereof. In other words, the next stage primary pulse is output immediately after the output of the preceding stage primary pulse. The primary pulses sequentially output in this manner do not overlap each other in respect of the logic levels. Practically, however, some jitter is induced due to waveform distortion in the rise and the fall of the pulses to consequently cause a mutual overlap.

Hereinafter the operation of producing secondary pulses $\phi$ will be described with reference to the timing chart of FIG. 3. As mentioned, the element NORn constituting a fixed pattern eliminating circuit is connected to the Nth stage element NANDn. The element NORn produces a pulse Cn as an output by executing a NOR process of the Nth stage primary pulse Bn and the preceding stage secondary pulse $\phi n$-1. As obvious from the timing chart of FIG. 3, the pulse Cn rises or turns on in synchronism with the fall of the preceding stage secondary pulse $\phi n-1$. Therefore, even if some jitter is included in the Nth stage primary pulse Bn, such jitter can be eliminated from the corresponding pulse Cn. This pulse Cn is delayed by a predetermined time length through the delay element DLYn to become a final secondary pulse $\phi n$. In this manner, the fixed pattern eliminating circuit controls, by using the preceding secondary pulse as a control signal, the output timing of the succeeding secondary pulse whose rise is the same in phase as the fall of the preceding secondary pulse, thereby eliminating the fixed overlap pattern. There never occurs any mutual overlap between the secondary pulses $\phi n-1$, $\phi n$, $\phi n+1$, . . . and so forth thus output sequentially after the process mentioned, hence solving the problem of vertical streak on the displayed image observed in the prior art.

Figure 4:
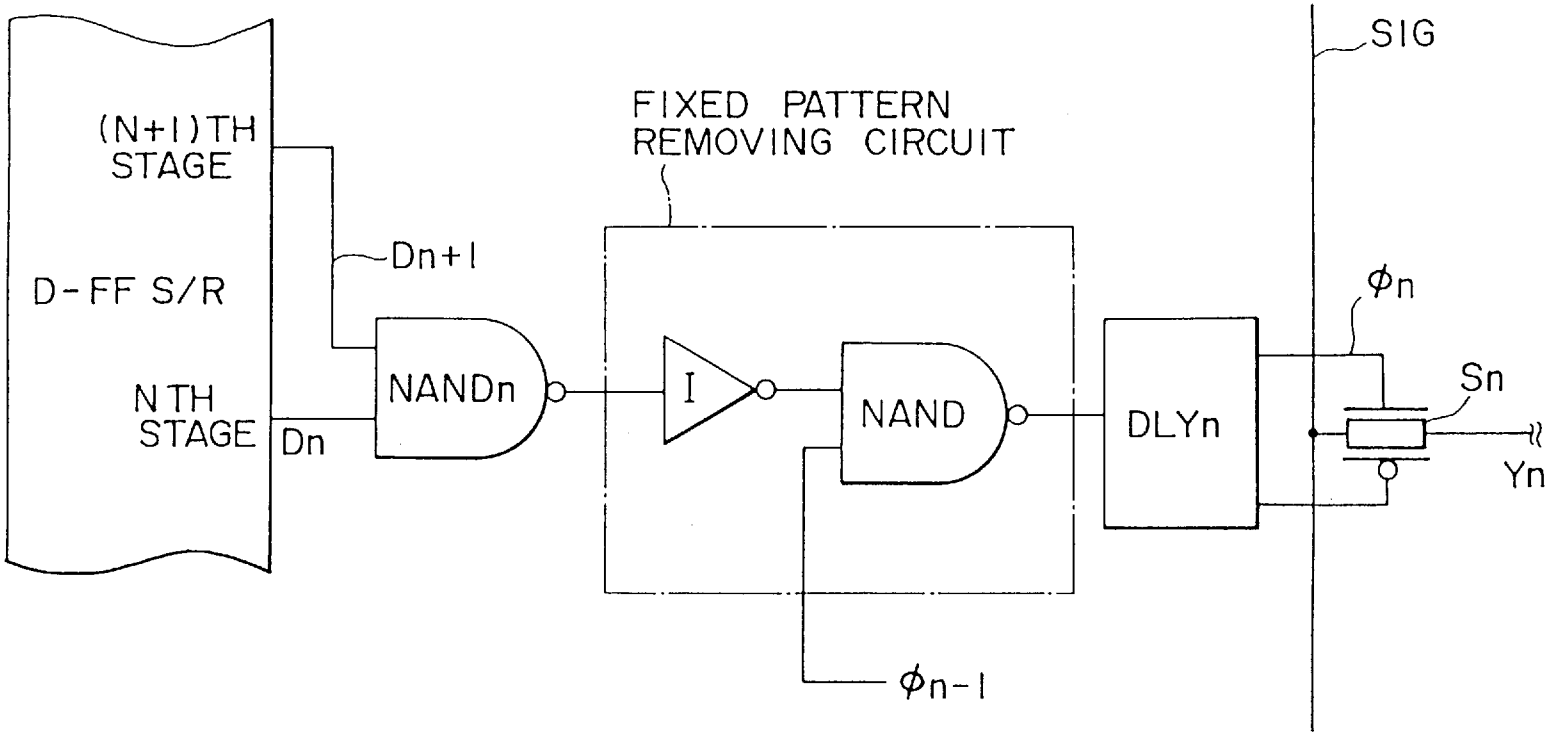
FIG. 4 is a circuit diagram of an exemplary modification of a fixed pattern eliminating circuit included in the horizontal driver circuit of FIG. 1.

FIG. 4 shows an exemplary modification of the aforementioned circuit of FIG. 1. For the purpose of making this modified circuit better understood with facility, the Nth stage of the horizontal scanner is extracted and shown. In FIG. 4, the same component elements as those employed in the circuit of FIG. 1 are denoted by the same reference numerals or symbols. The different point resides in that the fixed pattern eliminating circuit comprises a combination of an inverter I and a NAND element. The fixed pattern eliminating circuit of such configuration has the same function as that of the aforementioned fixed pattern eliminating circuit (NORn).

Figure 5:
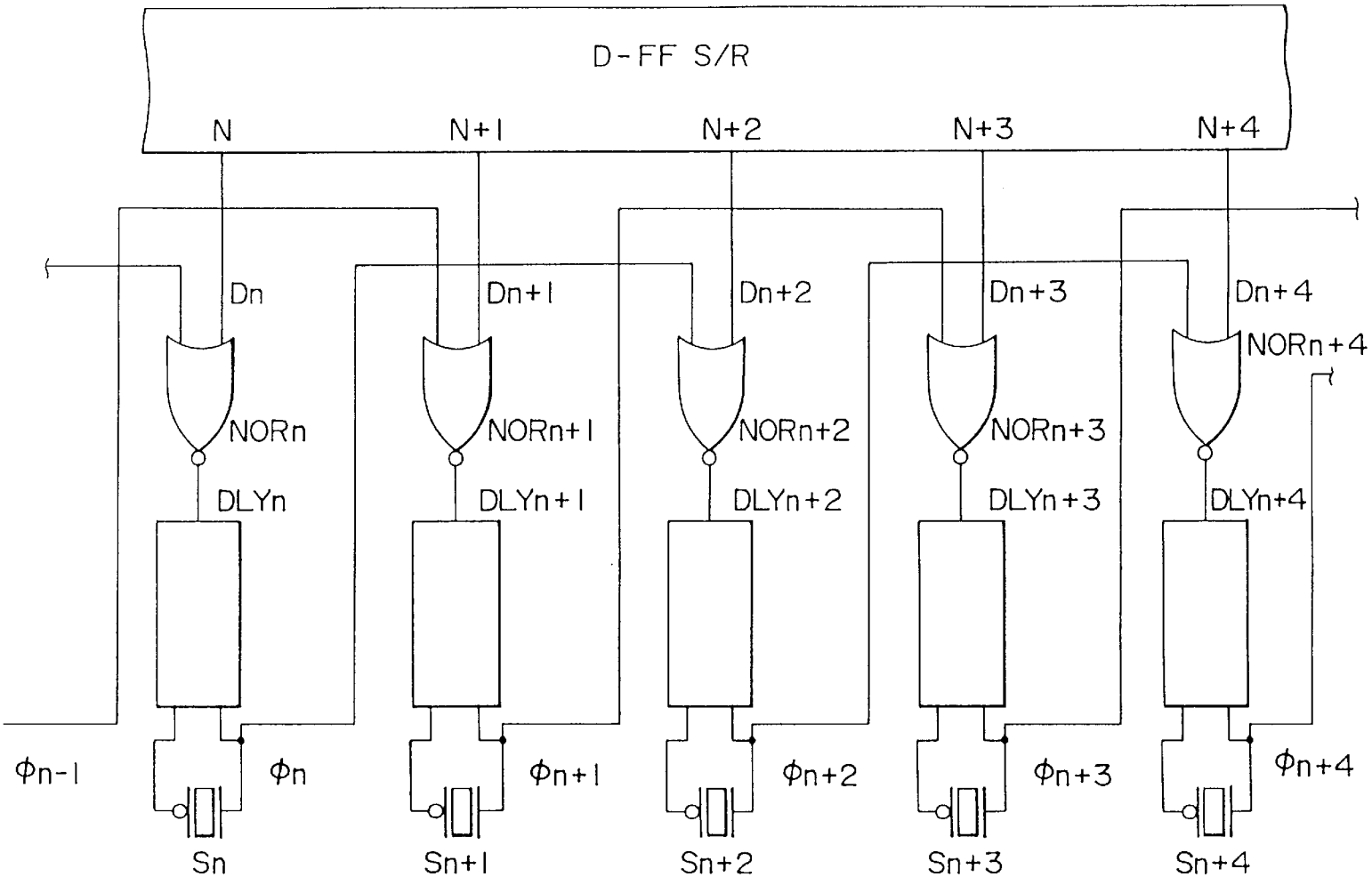
FIG. 5 is a circuit diagram of another embodiment representing the horizontal driver circuit of the invention.

Now another embodiment representing the horizontal scanner or driver of the present invention will be described below with reference to FIG. 5. In an attempt to facilitate the understanding, the same component elements as those employed in the circuit of FIG. 1 are denoted by the same reference numerals or symbols. The difference from the foregoing embodiment of FIG. 1 resides in that the NAND elements connected respectively to the output terminals of the individual stages in the shift register S/R are not employed. Therefore, in this embodiment, data pulses D output from the respective stages in the shift register are fed directly to the corresponding NOR elements. And in relation thereto, the secondary pulses $\phi$ from the ante-preceding stage is fed to the other input terminal of each NOR element, instead of the secondary pulse $\phi$ from the immediately preceding stage.

Figure 6:
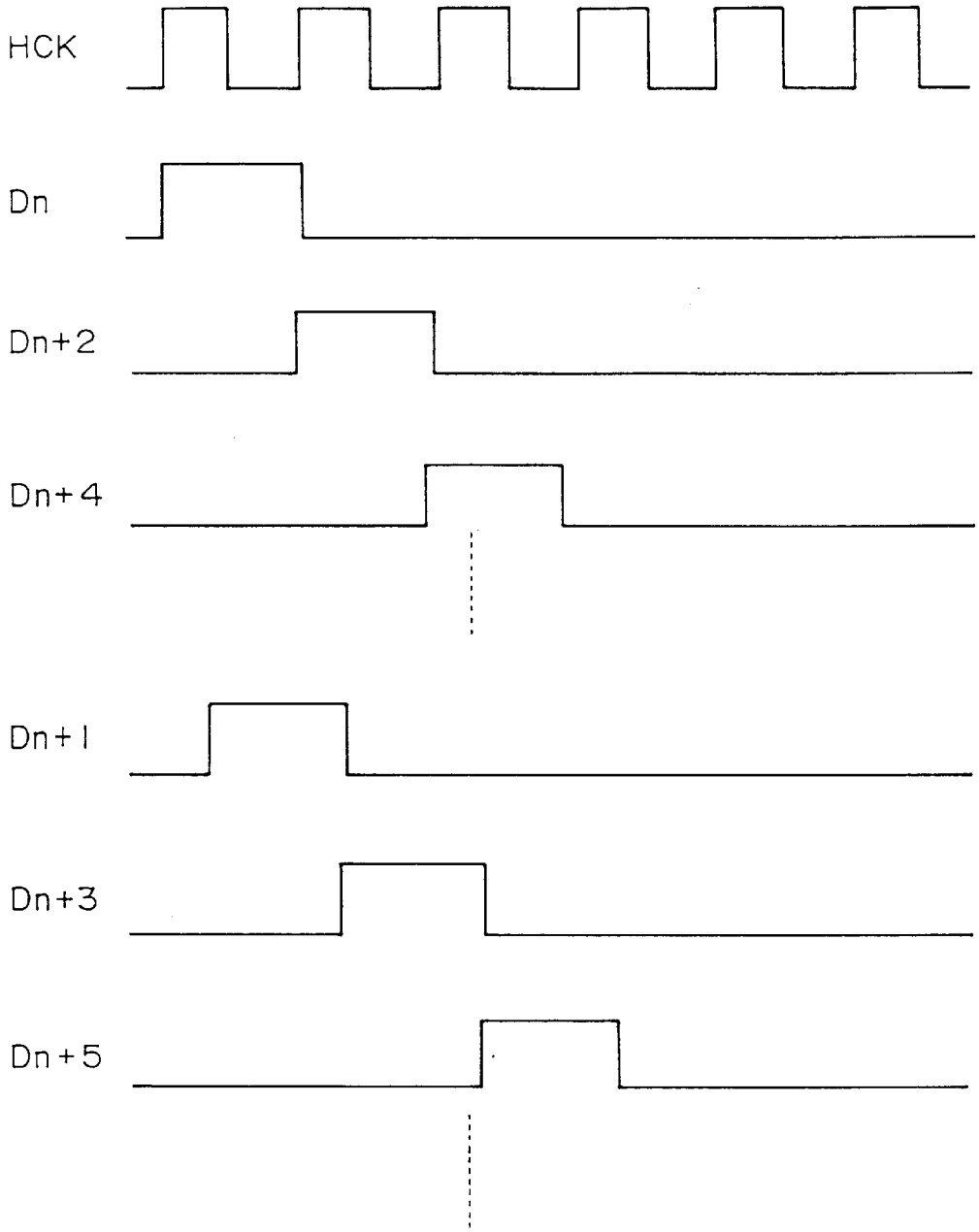
FIG. 6 is a timing chart of signals for explaining the operation of the horizontal driver circuit shown in FIG. 5.

Referring next to FIG. 6, a description will be given on the operation of the horizontal driver circuit shown in FIG. 5. As mentioned above, the shift register S/R sequentially outputs data pulses D each having a duration equal to one period of the clock signal HCK. The data pulses are mutually shifted by a time length equal to half the period of the clock signal. In this embodiment, the data pulses are divided into two groups. One group includes data pulses Dn, Dn+2, Dn+4, . . . of the even-numbered stages, while another group includes data pulses Dn+1, Dn+3, Dn+5, . . . of the odd-numbered stages. The data pulses of the even-stage group and those of the odd-stage group are used for sampling the video signals supplied from mutually different signal lines. In the same group, there may occur interference between the pulses due to the existence of some jitter. For this reason, the secondary pulse of the ante-preceding stage, instead of that of the immediately preceding stage, is used as a control signal for controlling the rise timing of the succeeding stage pulse. In the present invention, as mentioned, the preceding pulse is generally used as a control signal for controlling the output timing of any specific succeeding pulse which has a possibility of causing pulse interference, and such specific succeeding pulse is not limited merely to the next pulse alone as shown in FIG. 1.

Figure 7:
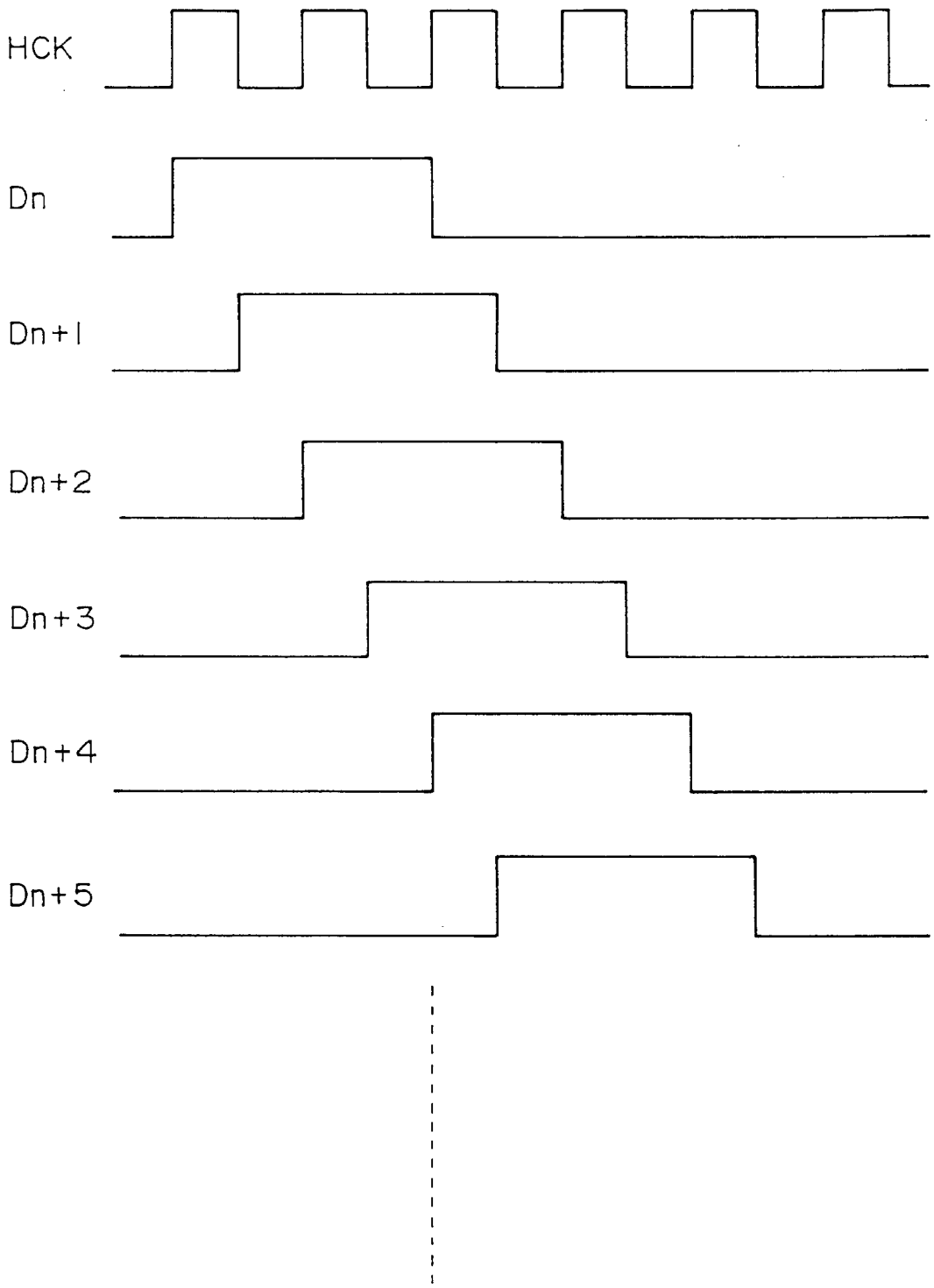
FIG. 7 is a timing chart of signals for explaining the operation of an exemplary modification of the horizontal driver circuit shown in FIG. 5.
Figure 8:
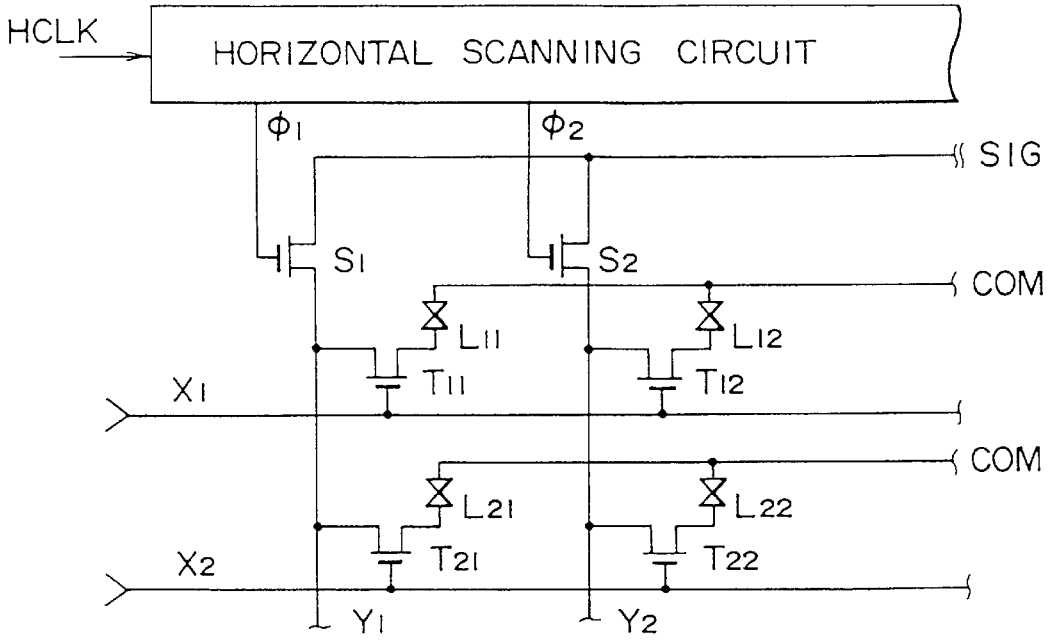
FIG. 8 is a circuit diagram of a conventional active matrix type liquid crystal display device.
Figure 9:
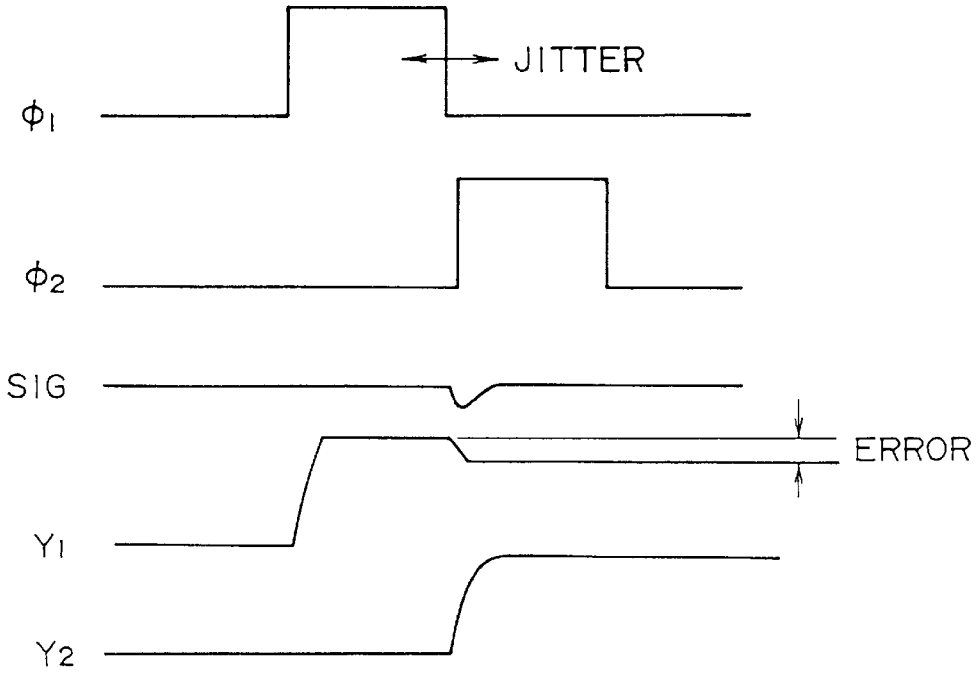
FIG. 9 is a timing chart of signals for explaining the problems in the conventional device of FIG. 8.

The situation to control the pulse generation timing with a time interval as mentioned above is induced in an exemplary case of FIG. 7 as well. In this example, the width of the data pulse D transferred in the shift register is set to a long duration which is equal to two periods of the clock signal HCK. In this case also, the shift register sequentially outputs data pulses Dn, Dn+1, Dn+2, Dn+3, Dn+4, Dn+5, . . . which are mutually shifted by a time length equal to half the period of the clock signal. As obvious from the timing chart of FIG. 7, pulse interference or bit interference occurs at an interval of three stages. Since the rise timing of, e.g., the succeeding data pulse Dn+4 is the same in phase as the fall timing of the preceding data pulse Dn, there exists a possibility of bit interference between such two pulses. In this case, therefore, the horizontal sampling pulse preceding by four stages is used as a control signal for controlling the output timing of the horizontal sampling pulse of the succeeding stage.

According to the present invention, as described hereinabove, there is attainable an advantageous effect that vertical streaks on a displayed image can be eliminated by incorporating a fixed pattern eliminating circuit in a horizontal driver circuit. The fixed pattern eliminating circuit has a relatively simplified configuration where the output timing of a succeeding pulse is controlled by the use of a preceding pulse, and the circuit function is not effected harmfully by any electric characteristic variations of the devices in the individual stages. And, remarkable effects can be achieved particularly in the case of applying the horizontal driver circuit, which is equipped with such fixed overlap pattern eliminating function, in an active matrix type liquid crystal display device based on the simultaneous R-G-B driving system.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

What is claimed is:

1. An addressing device comprising:

a plurality of gate lines arranged substantially in parallel with each other in the X-axis direction;

a plurality of data lines arranged substantially in parallel with each other in the Y-axis direction;

a first scanning means for supplying gate signals* sequentially to the gate lines;

a second scanning means for supplying data signals sequentially to the data lines, said second scanning means comprising a shift register for sequential pulses, a fixed pattern eliminating circuit associated with the shift register, a delay circuit for delaying outputs from the fixed pattern eliminating circuit, and switch elements for providing data signals to the data lines in response to outputs from the delay circuit, said fixed pattern eliminating circuit providing a non-overlap time of the horizontal sampling pulses between an Nth stage and an Mth stage which follows the Nth stage so that a rise of an Mth stage which follows the Nth stage so that a rise of an Mth stage pulse does not overlap with a fall of an Nth state pulse creating a phase difference between the rise of the Mth stage pulse and the fall of the Nth stage pulse; and active elements disposed at intersecting points of the fate and data lines.

2. The addressing device of claim 1 wherein said fixed pattern eliminating circuit comprises means for controlling the rise of the Mth stage horizontal sampling pulse by using the Nth stage horizontal sampling pulse as a control signal.

3. The addressing device of claim 1 wherein said Mth stage is an (N+1)th stage.

4. The addressing device of claim 1 wherein said active elements comprise thin film transistors.

5. The addressing device of claim 2 wherein said switch elements comprise a CMOS transmission gate.

6. A liquid crystal display device comprising:

a plurality of display elements arranged in a matrix, each display element comprising a picture element electrode and a switching element associated with the picture element electrode, said switching element having first and second electrodes;

a plurality of gate lines associated with the first electrodes;

a plurality of data lines associated with the second electrodes; and a scanning circuit for sampling video signals to be applied to the data lines, said scanning circuit having a means for generating a non-overlap time of horizontal sampling pulses between an Nth stage and an Mth stage posterior thereto so that a rise of an Mth stage pulse does not overlap with a fall of an Nth stage pulse creating a phase difference between the rise of the Mth stage pulse and the fall of the Nth stage pulse.

7. The liquid crystal display device of claim 6 wherein said Mth pulse is an (N+1)th pulses.

8. The liquid crystal display device of claim 6 wherein said rise of the Mt stage pulse is controlled by the Nth stage pulse.

9. The liquid crystal display device of claim 8 wherein said Mth stage is (N+2)th stage.

10. The liquid crystal display device of claim 8 wherein said Mth stage is an (N+4)th stage.

11. The liquid crystal display device of claim 6 wherein said switching element is a thin film transistor.

12. A horizontal driver circuit comprising:

a shift register for generating sequential data pulses; and means, associated with the shift register, for generating horizontal sampling pulses, said means having a fixed pattern eliminating circuit for providing a non-overlap time of the horizontal sampling pulses between an Nth stage and an Mth stage posterior thereto so that a rise of an Mth stage pulse does not overlap with a fall of an Nth stage pulse creating a phase difference between the rise of the Mth stage pulse and the fall of the Nth stage pulse.

13. The horizontal driver circuit of claim 12 wherein said means for generating has a delay circuit connected to the fixed pattern eliminating circuit.

14. The horizontal driver circuit of claim 12 wherein said sequential data pulses comprises an Nth stage pulse and an Mth stage pulse wherein a rise of the Mth stage data pulse overlaps with a fall of the Nth stage data pulse.

15. The horizontal driver circuit of claim 12 wherein said means for generating horizontal sampling pulses is connected to switch elements.

16. A horizontal driver circuit comprising:

a shift register for generating sequential pulses; and means associated with the shift register for generating horizontal sampling pulses, said means having a control means for controlling a rise of an Mth stage of the horizontal sampling pulses by receiving an Nth stage of the horizontal sampling pulses so that the rise of the Mth stage horizontal sampling pulse does not overlap with a fall of the Nth stage horizontal sampling pulse creating a phase difference between the rise of the Mth stage horizontal sampling pulse and the fall of the Nth stage horizontal sampling pulse, said Nth stage being prior to the Mth stage.

17. The horizontal driver circuit of claim 16 wherein said control means comprises a fixed pattern eliminating circuit for providing a non-overlap time of the horizontal sampling pulses between the Nth stage and the Mth stage.

18. The horizontal driver circuit of claim 16 wherein said Mth stage is an (N+1)th stage.

19. The horizontal driver circuit of claim 17 wherein said control means comprises a delay means connected to the fixed pattern eliminating circuit.

20. The horizontal driver circuit of claim 16 wherein said control means comprises NOR elements.

21. The horizontal driver circuit of claim 16 wherein said control means comprises a plurality of inverters and NAND elements coupled to the inverters.

* * * * *